US006105342A

United States Patent [19]

Hansen et al.

[11] Patent Number: 6,105,342

[45] Date of Patent: Aug. 22, 2000

[54] PACKAGING OF MEDICINAL PRODUCTS

[76] Inventors: Bernd Hansen, Heerstrasse 16, D-74429 Sulzbach-Laufen, Germany; Hermann Anhalm, Allmendstrasse 8, CH-4658 Däniken, Switzerland

[21] Appl. No.: 09/120,123

[22] Filed: Jul. 22, 1998

Related U.S. Application Data

[62] Division of application No. 08/398,695, Mar. 6, 1995, abandoned.

[30] Foreign Application Priority Data

Mar. 12, 1994 [DE] Germany ..... 44 08 394

[51] Int. Cl.[7] ..... B65B 5/00; B65D 85/38

[52] U.S. Cl. ..... 53/452; 206/5.1; 206/205

[58] Field of Search ..... 206/5.1, 205; 53/452, 53/453, 558, 561; 422/300; 425/317, 524

[56] References Cited

U.S. PATENT DOCUMENTS

| | | | |
|---|---|---|---|
| Re. 27,155 | 7/1971 | Hansen | 425/524 |
| 906,157 | 12/1908 | Porter | 215/48 |
| 1,081,555 | 12/1913 | Russell | 215/48 |
| 3,597,793 | 8/1971 | Weiler et al. | 425/317 |
| 4,056,914 | 11/1977 | Mnilk et al. | 53/453 |
| 4,332,318 | 6/1982 | Feldman | 206/5.1 |
| 4,425,090 | 1/1984 | Hansen | 425/503 |
| 4,703,610 | 11/1987 | Bach | 215/48 |
| 4,750,610 | 6/1988 | Ryder | 206/5.1 |
| 4,897,981 | 2/1990 | Beck | 206/5.1 |
| 4,995,519 | 2/1991 | Rose et al. | 215/47 |
| 5,307,943 | 5/1994 | Iidaka | 215/46 |
| 5,351,462 | 10/1994 | Anderson et al. | 53/452 |
| 5,687,550 | 11/1997 | Hansen et al. | 53/453 |

*Primary Examiner*—Jim Foster

*Attorney, Agent, or Firm*—Roylance, Abrams, Berdo & Goodman, L.L.P.

[57] ABSTRACT

In a package for contact lenses, especially single-wear contact lenses, the receiver is configured to contain a contact lens and protective cleaning liquid, and is configured as a plastic bottle with a detachable stopper.

15 Claims, 3 Drawing Sheets

PACKAGING OF MEDICINAL PRODUCTS

REFERENCE TO RELATED APPLICATION

This application is a divisional application of U.S. patent application Ser. No. 08/398,695, filed Mar. 6, 1995, now abandoned, the subject matter of which is hereby incorporated by reference.

FIELD OF THE INVENTION

The present invention relates to a package for contact lenses, particularly for single-wear contact lenses, in the form of a plastic bottle with a detachable stopper.

BACKGROUND OF THE INVENTION

A conventional package for contact lenses is blister packaging. An otherwise flat plastic sheet has a plurality of generally hemi-spherically shaped deformations on one side. Each of these deformations holds a contact lens. To protect the contact lenses from drying out, such a receiver formed by a deformation is also filled with a protective liquid. On the reverse side from the receivers, a metal foil is connected with the flat parts of the sheet so that all receivers are tightly sealed.

SUMMARY OF THE INVENTION

An object of the present invention involves providing an improved package for medicinal products, such as contact lenses, particularly single-wear contact lenses.

This object is attained according to the present invention by a package comprising a first receiver, configured as a plastic bottle for receiving a contact lens and a protective liquid to clean the contact lens, and a detachable stopper attached to the bottle.

Another object of the present invention involves providing an improved method for packaging medicinal products, such as contact lenses, particularly single-wear contact lenses.

The foregoing object is attained according to the present invention by a method of producing a package for medicinal products, comprising the steps of forming a receiver with a bottle body and a shaped neck from an extruded tube in a blow molding apparatus, while the bottle body is still positioned in the blow molding apparatus, inserting a protective liquid and a medicinal product into the receiver, and after insertion of the protective liquid and the medicinal product into the receiver, shaping a stopper to be tightly sealed on the neck from the extruded tube.

By being a self-contained unit and by avoiding the use of glue and binding materials, the package according to the present invention guarantees a high level of security against microbial and chemical contamination.

The package is especially useful for single-wear contact lenses. However, the package can also be used for other medicinal products.

Because each receiver is configured as a bottle, the package is especially easy to handle when being opened. Relative to the blister packing developed for carrying solid parts, a bottle constructed to receive and carry liquids offers the advantage that, during opening of the package, the protective liquid is not inadvertently spilled out.

The bottle is filled and sealed in the conventional manner for ampules. Thus, the manufacturing costs can be kept very low.

The inside cross section of the neck portion in all directions exceeds the cross section of a contact lens or of any other medicinal product stored therein. This arrangement prevents the contact lens from being jammed in the package neck during placement in and removal from in any orientation.

As a result of the special construction of the detaching or break line in an annular zone with decreased wall thickness, advantageously in the basic form of a constriction, the bottle is easy to open.

The stopper can advantageously be constructed so that even following opening of the receiver, the receiver can be tightly resealed. Thus, the protective liquid can be stored safely until its disposal as waste or a receiver can contain more than one contact lens.

With the construction of gripping contact areas on the stopper, the detaching or breaking away of the stopper from the rest of the receiver is facilitated.

In one preferred embodiment, a holding device holds the medicinal product, for instance a contact lens, in the receiver such that when the stopper is removed the medicinal product can be removed easily from the receiver. Advantageously, the holding device can be configured as an insert that can be removed from the receiver. A contact lens can then be grasped without any difficulty.

One-piece construction is possible. In a construction having the receiver and holding device separated from the stopper, all parts are easier to manufacture than in a one-piece construction.

By construction of a threading integral with a part of the receiver, the holding device can be guided and secured in a defined position within the receiver before and during breaking away of the stopper, and is guided during removal of the holding device.

When the holding device together with the stopper is removable from the receiver, the opening process is simplified.

If the contact lens is a soft contact lens, the holding device advantageously can be configured as a clamping device. The soft contact lens can be held securely in the clamping device either in rolled or in folded state, and can be removed easily.

A one-piece form of the package with a plurality of receivers, for instance, in the form of an ampule block in which a number of ampules are arranged one after the other, is advantageous.

With break points located between the individual receivers, the receivers can be separated from one another. The handling during removal of the contact lens is thereby considerably facilitated.

The method for producing the package according to the present invention has the advantage that the bottle bodies and the stoppers can be produced at low-cost, especially in terms of simultaneous production of a plurality of receivers or bottle bodies. With filling of the protective liquid and the contact lenses as well as closing while the bottle bodies are still in the blow mold, sterility and low production costs can be attained without any problem.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

The first embodiment of the package according to the present invention has a receiver in the form of an ampule for a contact lens and a protective liquid. This receiver can be resealed following opening.

Figure 1:
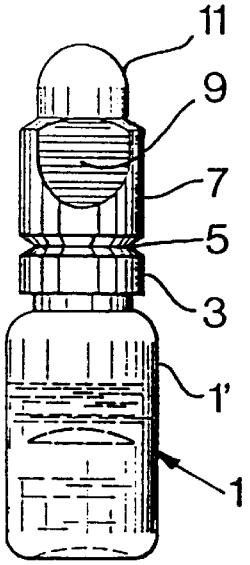
FIG. 1 is a side elevational view of a package according to a first embodiment of the present invention.

The receiver 1 is shown in FIG. 1 approximately in full scale. It is made of plastic. Receiver 1 has an axially symmetrical bottle body 1' connected to an axially symmetrical neck 3. The end of bottle body 1', opposite neck 3, is closed by a concave or inwardly convex bottom.

In the connection to bottle body 1', neck 3 has three segments one after the other. The inside diameter of each segment is smaller than that of bottle body 1'. A first cylindrical ring is joined to another ring with a similar cylindrical shape, but having a larger diameter. The second ring is joined to a segment which tapers conically until it reaches a detaching or break-away line 5. Breakaway line 5 has the same diameter as the first ring of neck 3. A stopper 7 is joined with neck 3 through break-away line 5.

The extended cylindrical main part of stopper 7 has the identical outside diameter as the second ring of neck 3. The end of stopper 7, adjacent to neck 3, has a tapering zone conically tapering toward break-away line 5. The tapering zone connects stopper 7 with neck 3 at break-away line 5. Break-away line 5 is then formed by the base of an area of constriction. The wall thickness at break-away line 5, relative to all other areas, is so greatly reduced that stopper 7 can be separated relatively easily from neck 3 with relatively slight force by rotating or tipping the stopper relative to bottle body 1'. Two gripping depressions 9, opposite one another, are formed on the outside cover surface of the main part of stopper 7.

On the end of stopper 7, opposite break-away line 5, a plug 11 is provided with a cylindrical part. The outside diameter of the cylindrical part corresponds to the inside diameter of neck 3, especially at break-away line 5 and in the area of the first ring of neck 3. The free end of plug 11 is formed by a hemisphere.

Figure 2:
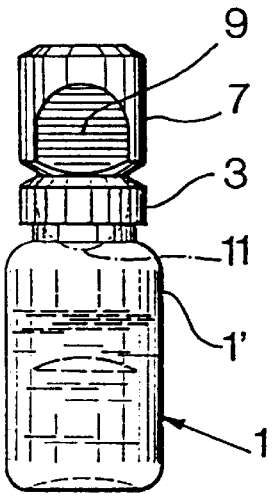
FIG. 2 is a side elevational view of the package of FIG. 1 with the plug introduced into the neck and sealed following the breaking away of the stopper other end.

If receiver 1, which is illustrated in closed state in FIG. 1, is opened, stopper 7 can be rotated and its end having plug 11 can be introduced into neck 3, as shown in FIG. 2. Receiver 1 is then tightly sealed because of the tight fitting dimensions of plug 11 and the inside diameter of neck 3.

After completion of manufacture, receiver 1 contains a contact lens and a protective liquid to keep the contact lens clean and sterile in bottle body 1'. The inside cross sectional dimensions of neck 3 are selected to exceed the cross sectional dimensions of the contact lens in all directions. Thus, the contact lens can be removed through neck 3 without jamming. To obtain the contact lens when it is required, receiver 1 is opened by breaking at detaching or break-away line 5. If receiver 1 holds more than one contact lens, or if no means of waste disposal of the protective liquid is available during opening of receiver 1, receiver 1 can be tightly resealed by the introduction of plug 11 into neck 3.

Figure 4:
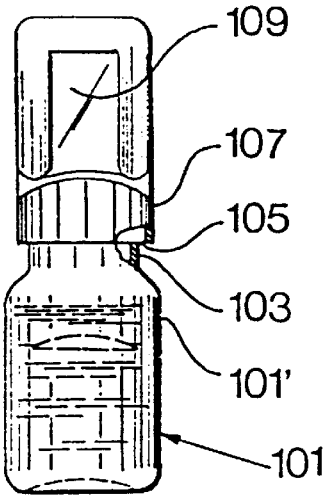
FIG. 4 is a side elevational view of a package according to a second embodiment of the present invention, partially in section in the area of the break line.
Figure 3:
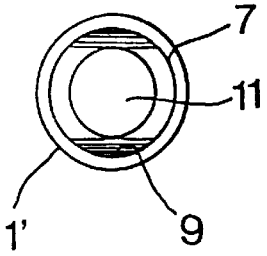
FIG. 3 is a top plan view of the package of FIG. 1.
Figure 5:
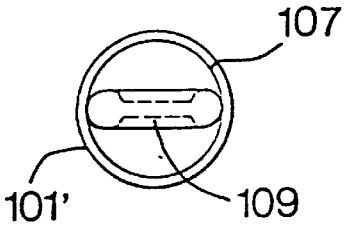
FIG. 5 is a top plan view of the package of FIG. 4.

In the second exemplary embodiment of FIGS. 4 and 5, the receiver 101 likewise is constructed as a plastic bottle of the shape and size of an ampule, and contains a contact lens and a protective liquid for the contact lens. Receiver 101 has a bottle body 101', as in the first embodiment, which is axially symmetrical and is constructed with a concave or inwardly convex bottom. On the end of bottle body 101' opposite the bottom, a cylindrical annular neck 103 is joined with the bottle body. An annular disk or ring plate shaped material part which projects radially from the outside cover surface of neck 103, and has inside and outside borders. The inside border is connected with neck 103, while the outside border is connected with a stopper 107. This material part has decreased wall thickness in comparison to the other parts of receiver 101, so that it forms a detaching or break-away line 105 between neck 103 and stopper 107.

Stopper 107 has a cylindrical area, axially parallel to neck 103. One end of the stopper is joined to the material part forming break-away line 105. The other end of this cylindrical area is sealed with formation of a curved cover and provided with a gripping contact point or member 109. Gripping member 109 is of rectangular configuration, and is connected at one narrow side with the other part of stopper 107. Along the three other sides, gripper contact point 109 has a bead. This bead has a circular cross sectional configuration perpendicular to the plane of gripper contact point 109.

By rotating or tipping gripper 109 relative to bottle body 101', the break-away line 105 is broken. Stopper 107 is then released from neck 103 and the contact lens can be removed.

If the contact lens is packaged to float loosely in the receiver, difficulties can arise during its removal. The finger of the user can become wet and sticky during removal by coming into contact with the protective liquid. These problems can be avoided by using a holding device for the contact lens.

Figure 6:
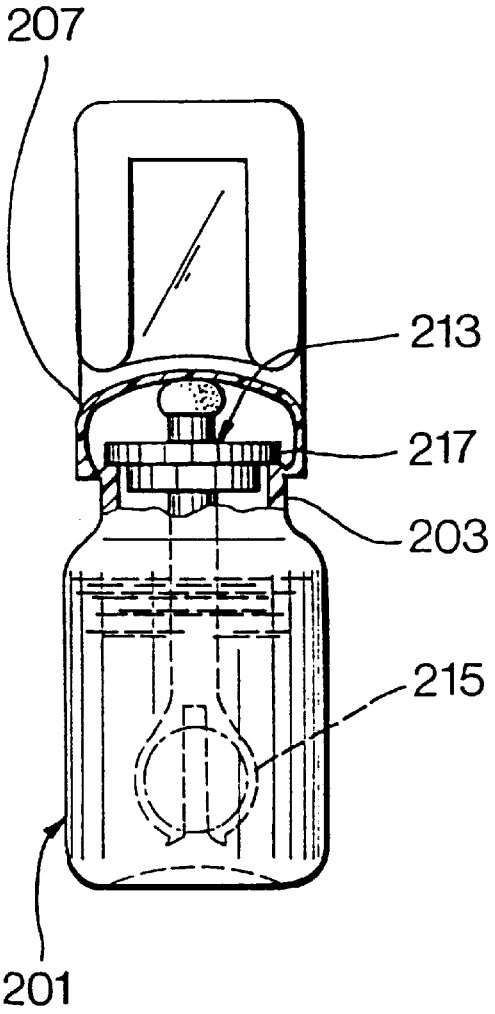
FIG. 6 is side elevational view, partially in section, of a package according to a third embodiment of the present invention.

The third embodiment of the package, illustrated in FIG. 6, shows a package with a holding device 213 for at least one medicinal product, for example a contact lens, especially a single-wear contact lens.

Receiver 201 comprises a neck 203 with a break-off stopper 207 as configured in the second embodiment.

Holding device 213 is arranged or mounted inside receiver 201. A holder cap 217 of holding device 213 is arranged partially in the area of neck 203 and partially encircled by stopper 207. A rod-like lens holder 215 can be mounted on holder cap 217. Holder 215 and cap 217 form the holding device 213 which projects into the bottle part of receiver 201. Holding device 213 constructed as an insert. When stopper 207 is broken off, holding device 213 can be removed from receiver 201.

Holder cap 217 is configured in one piece of three parts. A first cylindrical part of holder cap 217 is joined to lens holder 215, and has a smaller diameter than neck 203. When receiver 201 is closed, the first cylindrical part is arranged within neck 203. A second cylindrical part of holder cap 217 has a diameter exceeding the inner diameter of neck 203, and is joined to the first cylindrical part of holder cap 217 on the side thereof opposite the lens holder. The second cylindrical part of holder cap 217 is arranged within stopper 207. The two cylindrical parts of holder cap 217 have concentric axes and lie with frontal surfaces facing each other. These axes are also concentric with the axis of at the least partially rod-like configured lens holder 215. On the frontal surface opposite the first cylindrical part, the second cylindrical part of holder cap 213 has a gripping member which lies within stopper 207. Lens holder 215 is configured at its end opposite holder cap 217 to hold tightly a hard lens introduced into lens holder 215.

In the production of the packaging arrangement according to the present invention, holding device 213 is formed separately from and prior to receiver 201 and stopper 207. Following the construction of neck 203 and of the filling of the protective liquid with all of the lenses, the holding device is introduced to a certain distance into receiver 201, until the second cylindrical part of holder cap 217 engages the end of neck 203. Finally, stopper 207 is formed. This holds holder cap 217 in position on the end of the neck, since the neck presses against the free end of the gripper device. After the breaking away of stopper 207, holding device 213 can be removed from receiver 201. Because of the separate construction of stopper 207 and holding device 213, the conventional tools and method steps for production of ampules are still used.

With the use of soft lenses, instead of hard lenses, the contact lens could be inverted during removal from conventional contact lens packages. The occurrence of this problem is prevented by fixing the soft lens.

Figure 7:
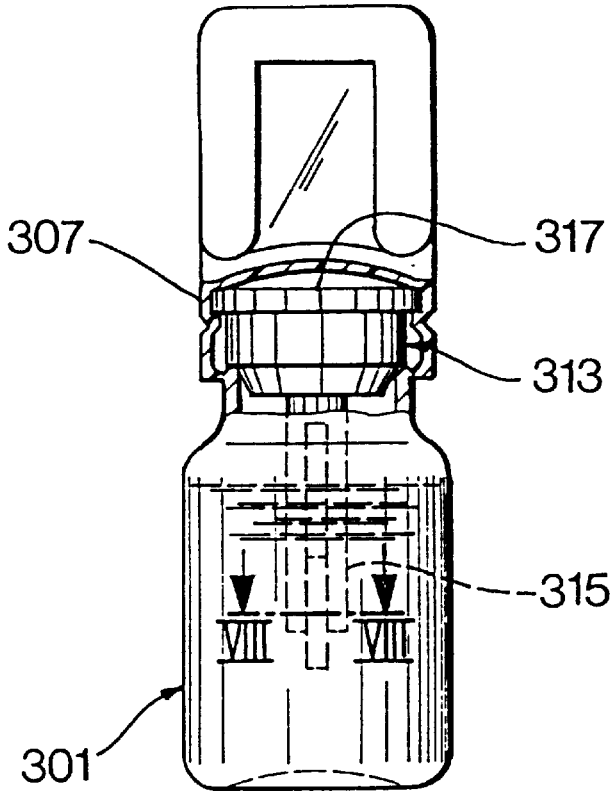
FIG. 7 is a side elevational view, partially in section, of a package according to a fourth embodiment of the present invention.
Figure 8:
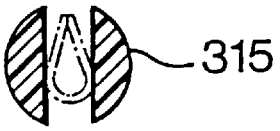
FIG. 8 is a top plan view in section taken along line VIII—VIII of FIG. 7 of the lens holder carrying a soft lens folded together.

The fourth embodiment of the package, illustrated in FIGS. 7 and 8, shows a removable holding device together with the stopper. The holding device is configured as clamping device for a folded together soft lens.

Receiver 301 is configured up to stopper 307 as in the second and third embodiments. Holder cap 317 of holding device 313, as in the third embodiment, has a part engaging the neck, but is configured in the fourth embodiment to be conical. A cylindrical part, with a diameter exceeding the inner diameter of the neck, is supported by holder cap 317 on the end of the neck. Instead of having the gripping arrangement built onto holder cap 317, the cap of the fourth embodiment has a disk or plate arranged concentrically to the other parts of holder cap 317 and shaped form-fitting on the side of holder cap 317 opposite the part engaged in the neck. The disk or plate diameter exceeds the diameter of the other parts of holder cap 317. The plate is engaged in an annular recess on the inside of stopper 307. Holding device 313 is thus fixed relative to stopper 307. The production and insertion of the holding device is accomplished by the same method as in the third embodiment. Stopper 307, however, is formed so that it loops tightly around holder cap 317.

Lens holder 315 of holding device 313 is configured as a clamping device. Two tongue-like, symmetrical parts, each with the cross sectional shape of a circular segment, leave an intermediate space free. A folded together soft lens is introduced into the intermediate space, and is clamped in the package during production of the package. Following the detaching/breaking away of stopper 307, the soft lens can be removed from holding device 313 with the user's fingers remaining dry. The soft lens automatically unfolds and lies on the finger in the shape required for use.

After opening the package, the package can be advantageously can be resealable. Resealing is particularly important when more than one contact lens is packaged or the protective liquid must be exchanged or disposed as waste.

Figure 9:
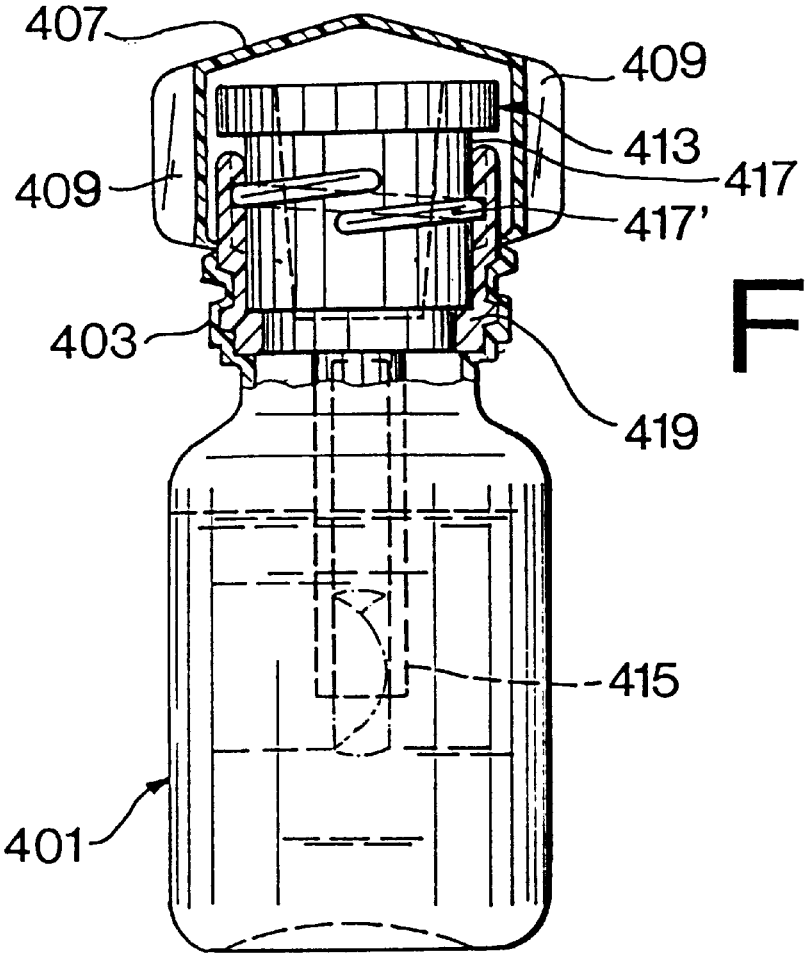
FIG. 9 is a side elevational view, partially in section, of a package according to a fifth embodiment of the present invention.
Figure 10:
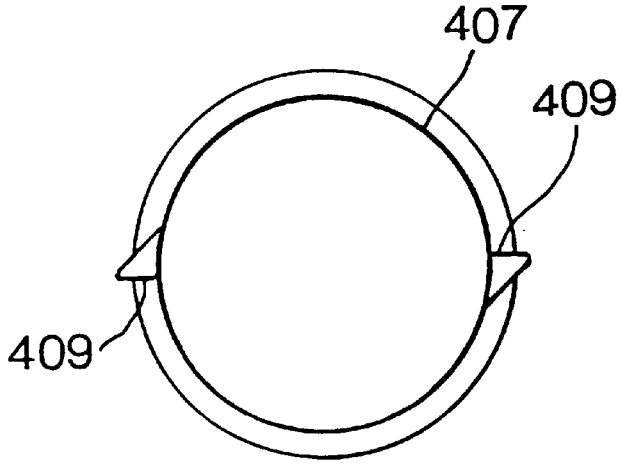
FIG. 10 is a top plan view of the package of FIG. 9.

The fifth embodiment of the package, illustrated in FIGS. 9 and 10, for medicinal products such as contact lenses, especially single-wear contact lenses, has a holding device with a threading. The threading engages in a threaded sheathing of the receiver.

A receiver 401 has a bottle body for the protective liquid and a neck 403 configured as in the other embodiments. A threaded sheathing 419, having an inside threading, is built into neck 403, but preferably is not configured of one piece with the neck. Neck 403 and threaded sheathing 419 engage one another by means of an undulating structure on the relevant sides facing each other. Threaded sheathing 419 is immovable relative to the longitudinal axis of receiver 401, so that threaded sheathing 419 forms a part of the receiver 401. As in the first through fourth embodiments, a detachable stopper 407 is attached to neck 403 by means of a break line 405. Stopper 407 has wing-like or lobe-like gripper members 409 arranged diametrically opposite each other on either side of the axis of receiver 401.

Holder cap 417 of holding device 413 is provided with outside threading 417' on a portion thereof received in neck 403. Outside threading 417' engages and fits securely into the inside threading of threaded sheathing 419. By the engagement of neck 403 and threaded sheathing 419, by the engagement of threaded sheathing 419 and holder cap 417, and by the mounting of a shoulder of holder cap 417 on a shoulder of threaded sheathing 419, the neck, threaded sheathing and holder cap are connected tightly with one another. Thus, even when stopper 407 is broken off, receiver 401 is sealed tightly.

As part of a clamping device the lens holder 415 has an opening on its end facing downwardly from holder cap 417. Lens holder 415 can receive a rolled up soft lens. Otherwise, lens holder 415 has the same construction as the lens holder of the fourth embodiment, but configured with a larger inside dimension.

For the opening of receiver 401, before and during the breaking off/detachment of stopper 407, holding device 413 is secured in a defined position within receiver 401. After detachment of stopper 407, holding device 413 must be rotated out of or unthreaded from the threaded sheathing 419. Threaded sheathing 419 guides holding device 413 to be able to remove the contact lens from lens holder 415. After removal of the contact lens, with the aid of the threading between holding device 413 and threaded sheathing 419, receiver 401 can be resealed by rescrewing holding device 413 into threaded sheathing 419.

In production, the holding device and the threaded sheathing advantageously can be prefabricated and screwed together and the lens holder can be provided with a contact lens before this insert part assembly is set in place in the neck, following the construction of the bottle body and the filling of protective liquid into the partially constructed and integrated neck. After insertion of holding device-threaded sheathing assembly into the neck, the undulating structure of the neck can be formed by pressing the neck radially inwardly onto the threaded sheathing. This production system is disclosed in U.S. Pat. No. 4,425,090 to Hansen, the subject matter of which is hereby incorporated by reference.

The lens holder for hard lenses and for folded together or rolled up soft lenses described in connection with the third, fourth and fifth embodiments could be combined with any of the holder caps described in these embodiments to obtain different embodiments. Furthermore, the shapes and dimensions of the bottle and the stopper of the various embodiments can be combined with the different holder devices.

For larger packaging units, a packaging arrangement can be advantageously provided with a plurality of receivers. In such packaging arrangement, the receivers are advantageously parallel and arranged with small spacing between them to form a block. To stabilize such block during handling, for example, for a still greater number of units, hollow bodies could be formed out of the scrap border zones, as shown for example in U.S. patent application Ser. No. 07/637,971, entitled Process For Producing Hollow Plastic Receptacles and filed on Jan. 9, 1991 in the name of Bernd Hansen, the subject matter of which is hereby incorporated by reference. The break/detaching lines can be advantageously formed between the individual receivers and arranged in the scrap border zone. Following the removal of the first contact lens from a receiver, the empty receiver can be broken off, and the packaging arrangement can be brought to the dimensions which correspond to the number of contact lenses still held therein. The packaging arrangement then assumes the more handy and convenient form.

For the method of production of the package or packaging arrangement, the tool preferably has four parts. An extruded tube of plastic material is introduced between two bottom halves of the tool. Through pressure inside the tube and/or vacuum pressure on the outside, a bottle body is formed for each receiver, with a bottom and a shaped neck. In the packaging arrangements with hollow bodies in the scrap border zones, these hollow bodies are preferably formed simultaneously with the bottle bodies. In the next step of the method, with the bottle body still located in the blow mold, the protective liquid and the contact lens or other medicinal product are introduced into the receiver. In embodiments with holding devices, these devices are prefabricated, preferably completely of plastic material, fitted with a contact lens or the like, and after introduction of protective liquid, are mounted in any receiver. In the last step of the method, both top halves of the tool are guided up to the packaging arrangement and thereby the stopper or stoppers can be formed on the neck or necks. Thus the receivers are tightly sealed and the tool can then release the finished packaging arrangement.

While various embodiments have been chosen to illustrate the invention, it will be understood by those skilled in the art that various changes and modifications can be made therein without departing from the scope of the invention as defined in the appended claims.

What is claimed is:

1. A method of producing a package of a contact lens and a protective liquid, comprising the steps of:

forming a bottle body with an integrally formed neck from an extruded tube in a blow molding apparatus, the neck being formed with an inner cross-sectional dimension greater than all cross-sectional dimensions of the contact lens, while the bottle body is still positioned in the blow molding apparatus, inserting a protective liquid and at least one contact lens into the bottle body, after insertion of the protective liquid, and the contact lens into the bottle body, forming an integral and removable closure member on the neck of the bottle body from the extruded tube to seal the bottle body hermetically with the protective liquid and the contact lens sealed in the bottle body while the bottle body is still positioned in the blow molding apparatus, forming a separation area between and connecting the closure member to the neck, and the contact lens being removable from the bottle body after removal of the closure member.

2. A method according to claim 1 wherein the protective liquid is inserted into the bottle body with the at least one contact lens at the same time.

3. A method according to claim 1 wherein the separation area is formed as an annular region of reduced wall thickness to provide a predetermined breaking point.

4. A method according to claim 3 wherein the separation area is formed as a constriction between the closure member and the neck.

5. A method according to claim 1 wherein the bottle body is formed as an ampule.

6. A method according to claim 1 wherein the closure member is formed with a stopper, on a side thereof remote from the separation area, which is introduced and sealed in the neck after separation of the closure member from the neck.

7. A method according to claim 6 wherein the closure member is formed, adjacent the separation area, with a substantially cylindrical outer surface and two oppositely arranged, gripping depressions.

8. A method according to claim 1 wherein the closure member is formed with a handle part extending substantially in a radial plane on a side of the closure member remote from the separation area.

9. A method according to claim 1 wherein the contact lens is held in a holding device during insertion into the bottle body before forming of the closure member;

the holding device with the contact lens is removable from the bottle body after removal of the closure member; and the holding device is constructed as an insert.

10. A method according to claim 9 wherein the holding device is formed separately from the closure member.

11. A method according to claim 10 wherein the holding device has a screw thread and is threadedly engaged in a part of the bottle body.

12. A method according to claim 9 wherein the holding device is coupled to the closure member and is removed simultaneously with the closure member from the bottle body.

13. A method according to claim 9 wherein the holding device is formed with a clamping device receiving a folded, soft contact lens.

14. A method according to claim 1 wherein a plurality of bottle bodies with necks and closure members are formed in one piece and are separated by predetermined breaking points therebetween.

15. A method of producing a package of a contact lens and a protective liquid, comprising the steps of:

forming a bottle body with an integrally formed neck from an extruded tube in a blow molding apparatus, the neck being formed with an inner cross-sectional dimension greater than all cross-sectional dimensions of the contact lens, while the bottle body is still positioned in the blow molding apparatus, inserting a protective liquid into the bottle body, mounting a contact lens in a lens holder, constructed as an insert, and inserting the combination of the contact lens and the lens holder into the bottle body through the neck while the bottle body is still positioned in the blow molding apparatus, after insertion of the protective liquid, the lens holder and the contact lens into the bottle body, forming an integral and removable closure member on the neck of the bottle body from the extruded tube to seal the bottle body hermetically with the protective liquid, the contact lens and the lens holder sealed in the bottle body while the bottle body is still positioned in the blow molding apparatus, forming a separation area between and connecting the closure member to the neck, and the lens holder with the contact lens being removable from the bottle body after removal of the closure member.

* * * * *